US010767865B2

(12) United States Patent
Roesler

(10) Patent No.: US 10,767,865 B2
(45) Date of Patent: Sep. 8, 2020

(54) SWIRL STABILIZED VAPORIZER COMBUSTOR

(71) Applicant: Rolls-Royce North American Technologies Inc., Indianapolis, IN (US)

(72) Inventor: Timothy C Roesler, Plainfield, IN (US)

(73) Assignee: Rolls-Royce North American Technologies Inc., Indianapolis, IN (US)

( * ) Notice: Subject to any disclaimer, the term of this patent is extended or adjusted under 35 U.S.C. 154(b) by 207 days.

(21) Appl. No.: 15/603,396

(22) Filed: May 23, 2017

(65) Prior Publication Data

US 2017/0356657 A1 Dec. 14, 2017

Related U.S. Application Data

(60) Provisional application No. 62/349,309, filed on Jun. 13, 2016.

(51) Int. Cl.
*F23R 3/14* (2006.01)
*F23R 3/32* (2006.01)
(Continued)

(52) U.S. Cl.
CPC ..... *F23R 3/286* (2013.01); *F23D 11/402* (2013.01); *F23D 11/406* (2013.01);
(Continued)

(58) Field of Classification Search
CPC ... F23R 3/30; F23R 3/32; F02M 53/06; F23D 11/443; C01B 2203/1294; F05D 2240/36; F23N 2037/14
See application file for complete search history.

(56) References Cited

U.S. PATENT DOCUMENTS 2,595,765 A * 5/1952 Stanley ..... F23C 99/00 60/738
2,827,761 A * 3/1958 Schirmer ..... F23R 3/32 60/39.23

(Continued)

FOREIGN PATENT DOCUMENTS

WO WO 2015/054140 A1 4/2015

OTHER PUBLICATIONS

Arthur H. Lefebvre, Gas Turbine Combustion, pp. 448-451, Hemisphere Publishing Corporation, New York, Jun. 1983, West Lafayette, Indiana.

*Primary Examiner* — Gerald L Sung
*Assistant Examiner* — Rene D Ford
(74) *Attorney, Agent, or Firm* — Brinks Gilson & Lione

(57) ABSTRACT

A gas turbine engine and a combustor are described herein. The combustor includes a fuel vaporizer coupled to a combustor wall, which extends into a combustion chamber. A fuel injector having a nozzle extends within a portion of the fuel vaporizer. A dome swirler is coupled to an upstream dome portion of the combustor wall. The swirler surrounds a heat shield, which may have a concaved body. The outlet end of the fuel vaporizer is disposed over the heat shield, which may be over the central zone of the heat shield, to face the heat shield. The fuel vaporizer may be coupled to the combustor wall and disposed outside the swirler. Fuel and air mixture exits the vaporizer and impinges against the heat shield and is then combined with the swirler air to become part of the primary zone recirculation.

23 Claims, 3 Drawing Sheets

(51) Int. Cl.

| | |
|---|---|
| ***F23R 3/30*** | (2006.01) |
| ***F23R 3/28*** | (2006.01) |
| ***F23D 11/40*** | (2006.01) |
| ***F23D 11/44*** | (2006.01) |

(52) U.S. Cl.
CPC ..... *F23D 11/441* (2013.01); *F23R 3/14* (2013.01); *F23R 3/32* (2013.01); *F23R 3/30* (2013.01)

(56) References Cited

U.S. PATENT DOCUMENTS 2,859,588 A * 11/1958 Wilson ..... F23R 3/18 60/767
2,931,174 A * 4/1960 Sidney ..... F23R 3/08 60/39.826
2,956,404 A * 10/1960 Kassner ..... F23R 3/32 60/738
3,430,443 A * 3/1969 Parnell ..... F23R 3/02 60/732
3,579,983 A * 5/1971 Caruel ..... F23R 3/06 431/352
3,913,318 A * 10/1975 Fox ..... F23R 3/32 60/738
3,916,619 A * 11/1975 Masai ..... F23R 3/12 60/756
3,952,503 A * 4/1976 Fox ..... F23R 3/10 60/738
4,085,581 A * 4/1978 Caruel ..... F23R 3/002 60/738
4,242,863 A * 1/1981 Bailey ..... F02C 3/24 60/738
4,249,373 A * 2/1981 Sotheran ..... F23R 3/34 60/39.826
4,275,564 A * 6/1981 Kappler ..... F23R 3/32 60/738
RE30,925 E * 5/1982 Smith ..... F23R 3/32 60/733
4,374,466 A * 2/1983 Sotheran ..... F23R 3/30 60/738
4,389,185 A * 6/1983 Alpkvist ..... F23C 7/06 431/164
4,549,402 A 10/1985 Saintsbury et al.
4,561,257 A * 12/1985 Kwan ..... F23D 11/008 60/737
4,742,684 A * 5/1988 Sotheran ..... F23D 11/443 60/738
5,133,192 A * 7/1992 Overton ..... F23D 11/005 431/210
5,197,278 A * 3/1993 Sabla ..... F23R 3/34 60/733
5,277,022 A * 1/1994 Shekleton ..... F23R 3/54 60/737
5,321,951 A * 6/1994 Falls ..... F23R 3/34 60/740
5,623,827 A * 4/1997 Monty ..... F23R 3/10 60/747
5,956,955 A * 9/1999 Schmid ..... F23R 3/283 60/748
7,146,816 B2 * 12/2006 Anderson ..... F23R 3/002 60/772
7,168,949 B2 * 1/2007 Zinn ..... F23C 5/24 431/116
7,320,440 B2 * 1/2008 Prociw ..... F23D 11/24 239/402
7,425,127 B2 * 9/2008 Zinn ..... F23C 5/24 431/115
7,966,822 B2 * 6/2011 Myers ..... F02C 3/145 60/758
9,021,812 B2 * 5/2015 Pardington ..... F23R 3/14 60/748
9,212,823 B2 * 12/2015 Boardman ..... F23R 3/286
9,879,862 B2 * 1/2018 McCormick ..... F23R 3/52
2003/0046936 A1 * 3/2003 Oechsle ..... F23R 3/007 60/748
2008/0053062 A1 * 3/2008 Tuttle ..... F02C 7/22 60/226.1
2012/0186264 A1 * 7/2012 Hoke ..... F23R 3/06 60/776
2016/0186661 A1 * 6/2016 Smith ..... F02C 7/18 60/782
2016/0245525 A1 * 8/2016 Snyder ..... F23R 3/06
2016/0376997 A1 * 12/2016 Prociw ..... F23R 3/002 60/739
2017/0003031 A1 * 1/2017 Boardman ..... F23R 3/286

* cited by examiner

SWIRL STABILIZED VAPORIZER COMBUSTOR

CROSS-REFERENCE TO RELATED APPLICATIONS

This application is a non-provisional application of, and claims priority under 35 USC § 119(e) to, U.S. provisional application 62/349,309, filed Jun. 13, 2016, the entire contents of which are incorporated by reference.

TECHNICAL FIELD

This disclosure relates to combustors for gas turbine engines, and in particular to systems and methods associated with fuel vaporizer arrangements for use in combustors of gas turbine engines.

BACKGROUND

Gas turbine engines include a combustor where a mixture of fuel and air is ignited to complete a combustion process. Air is typically compressed by an upstream compressor system before being provided to the combustor. Fuel is typically provided by a fuel system, including, for example, an injector and/or a vaporizer fuel delivery device. After combustion, the combustor directs the combusted air to a downstream turbine through the discharge or turbine nozzle. Vaporizer fuel delivery devices may be preferred in some instance over high-pressure injector fuel system due to cost benefits as well as soot control and simpler control systems. Present approaches using a vaporizer fuel delivery system within combustors suffer from a variety of drawbacks, limitations, and disadvantages. There is a need for the inventive vaporizer fuel delivery arrangement, systems and methods disclosed herein.

BRIEF SUMMARY

Disclosed herein are examples of a gas turbine engine and a combustor with a fuel vaporizer. The combustor includes a combustor wall including an upstream wall portion interconnected between an inner wall structure and an outer wall structure to define a combustion chamber. A vaporizer tube is coupled to the combustor wall extending into the combustion chamber. The vaporizer tube includes a first end opening and a second end opening. A fuel injector having a nozzle may be extended within a portion of the vaporizer tube through the first end opening. A swirler is coupled to the upstream wall portion. A heat shield is disposed along the upstream wall portion, and surrounded by the swirler. The second end opening of the vaporizer tube is disposed over the heat shield to face the heat shield. The vaporizer tube may be shaped to place the second end opening over the heat shield. The fuel injector may have an outer cross-sectional area sized smaller than an inner cross-sectional area of the first end opening and the vaporizer tube to define a compressed air passageway into the vaporizer tube. The vaporizer tube may be disposed outside the periphery of the swirler.

BRIEF DESCRIPTION OF THE DRAWINGS

The embodiments may be better understood with reference to the following drawings and description. The components in the figures are not necessarily to scale. Moreover, in the figures, like-referenced numerals designate corresponding parts throughout the different views.

DETAILED DESCRIPTION

Disclosed herein are examples of gas turbine engines and combustion systems that may be used in any industry, such as, for example, to power aircraft, watercraft, power generators, and the like. A fuel vaporizer system generally includes a vaporizer tube coupled to a pressurized fuel system. A mounting end of the vaporizer tube may mount to the wall of the combustor, allowing the tube to be immersed in the hot combustor. As a result, the air may be heated from the combustion process which aids in vaporizing the fuel and in pre-mixing the vaporized fuel with air.

A combustor including the fuel vaporizer system and a dome swirler system arrangement may have improved fuel-air mixing and combustion stability, especially in higher fuel-air ratio combination systems. The vaporizer tube may be configured to receive the fuel outside the dome swirler system and to deliver a fuel-air mixture inside the dome swirler system. For example, fuel-air mixture may exit the vaporizer tube to impinge against a heat shield that may be disposed at the central part of the dome swirler system. The heat shield may have a concaved body. The impinging fuel-air mixture may be then combined with the swirler toroidal recirculation air to become part of the primary zone recirculation in the combustor, which may provide improved mixing and stability characteristics required for engines operating at any fuel-air ratio, especially higher fuel-air ratios. This has been found as an improvement over vaporizer tube arrangements without a dome swirler that deliver fuel-air mixture in only a single-sided recirculation pattern within the combustor.

Figure 1:
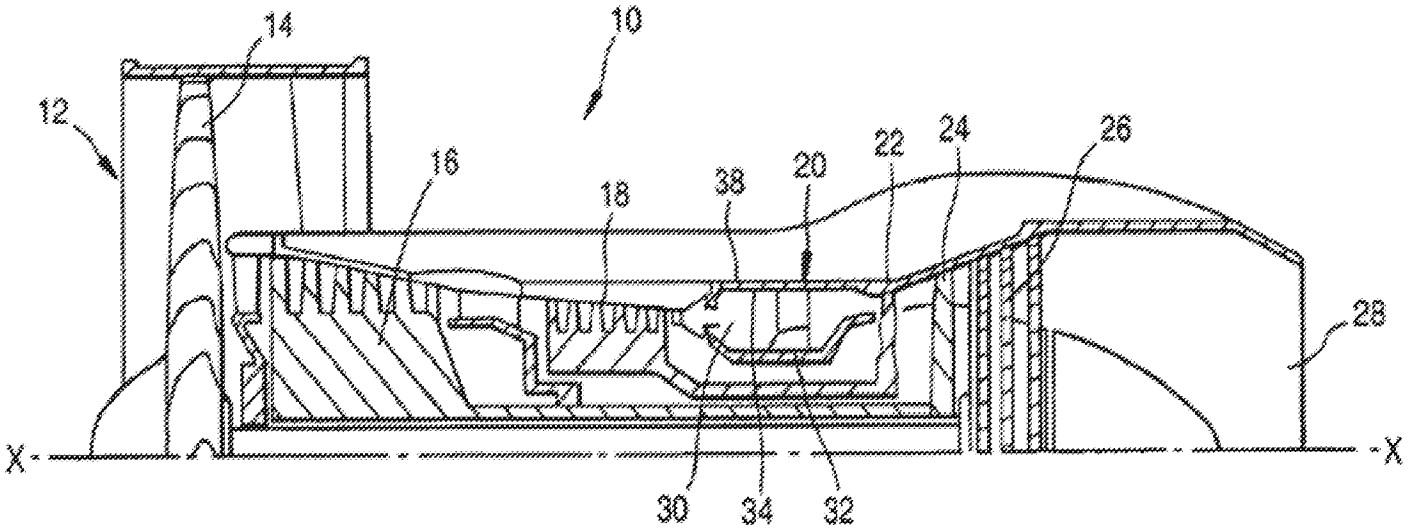
FIG. 1 illustrates a gas turbine engine with a combustor.

With reference to FIG. 1 a gas turbine engine generally indicated at 10 includes, in axial flow series, an air intake 12, a propulsive fan 14, an intermediate pressure compressor 16, a high pressure compressor 18, combustion equipment 20, turbine(s) (a high pressure turbine 22, an intermediate pressure turbine 24, a low pressure turbine 26) and an exhaust nozzle 28.

The gas turbine engine 10 works in the conventional manner so that air entering the intake 12 is accelerated by the fan 14 to produce two air flows, a first air flow into the intermediate pressure compressor 16 and a second airflow which provides propulsive thrust. The intermediate pressure compressor 16 compresses the air flow directed into it before delivering the air to the high pressure compressor 18 where further compression takes place.

Figure 2:
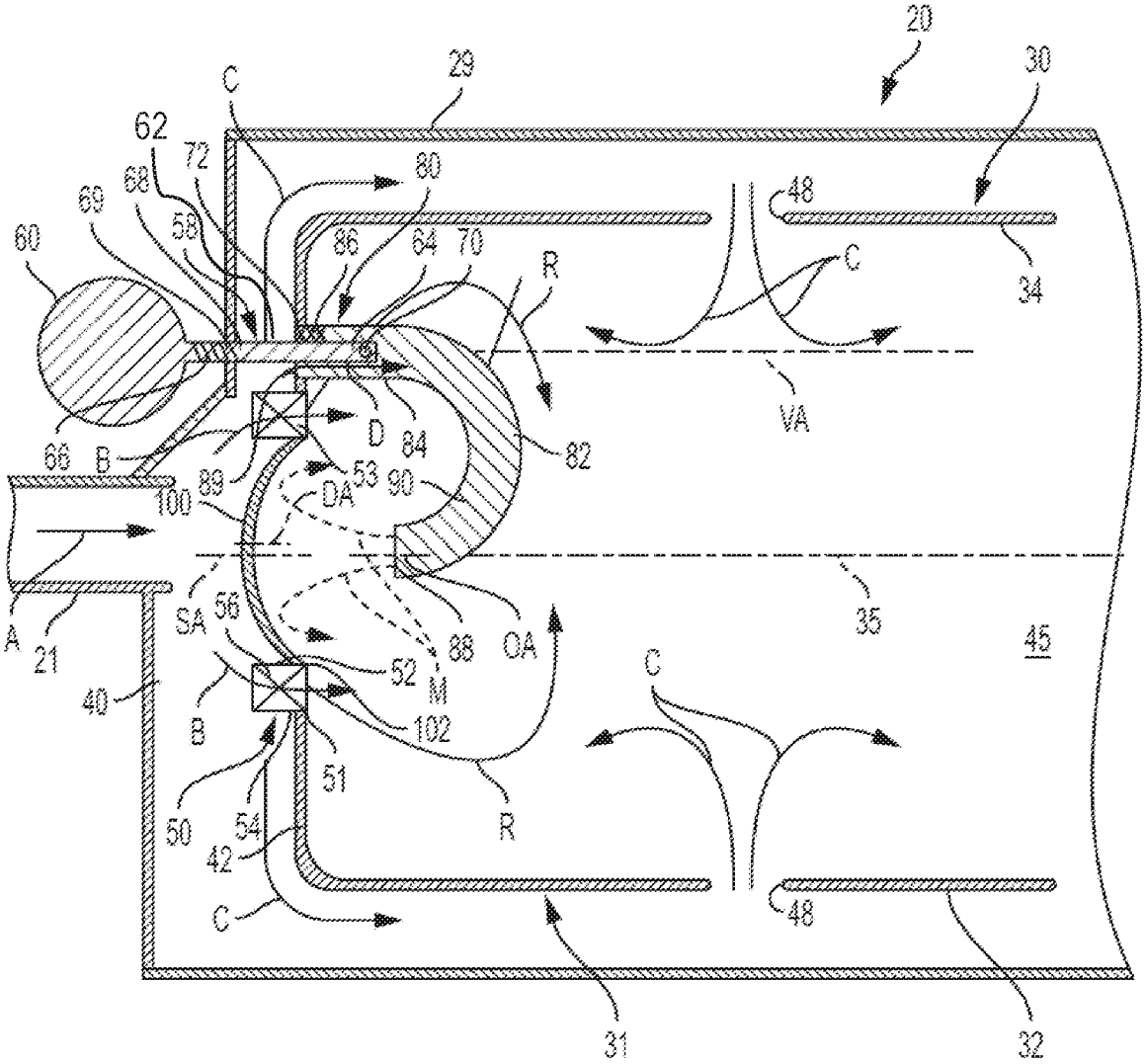
FIG. 2 illustrates an example of a combustor.

With additional reference to FIG. 2, the compressed air exhausted from the high pressure compressor 18 is directed into the combustion equipment 20 via a diffuser inlet 21 where it is mixed with fuel and the mixture combusted. The resultant hot combustion products then expand through and thereby drive the high, intermediate and low pressure turbines 22, 24 and 26 before being exhausted through the exhaust nozzle 28 to provide additional propulsive thrust. The high, intermediate and low pressure turbines 22, 24 and 26 respectively drive the high and intermediate pressure compressors 16 and 18 and the fan 14 by suitable interconnecting shafts.

Fuel may be directed into the combustor 30 through a number of fuel injectors located at the upstream end of the combustor 30. The fuel injectors are circumferentially spaced around the engine 10 and serve to provide fuel into air derived from the high pressure compressor 18. The resultant fuel and air mixture may be then combusted within the combustor 30.

An outer casing 29 of the combustion equipment 20 surrounds the combustor 30 in a manner to define an annular plenum 40 there between. The combustor 30 has a combustor wall 31 including an annular combustor dome or upstream wall portion 42 interconnected between a tubular combustor inner wall structure 32 spaced from the outer casing 29 and a tubular combustor outer wall structure 34 spaced from the outer casing 29 to define different aspects of the plenum 40. The inner wall structure 32 and the outer wall structure 34 each may be extended axially downstream along a longitudinal centerline (X-X) of the engine 10 from the upstream wall structure 42 towards the turbines, thereby defining a combustion chamber 45. The combustion chamber 45 may be defined about a longitudinal centerline 35 of the combustor 30 positioned between the inner wall structure 32 and the outer wall structure 34, which may be typically disposed along the longitudinal centerline (X-X) of the engine. The upstream wall portion 42, the inner wall structure 32 and the outer wall structure 34 may be constructed as a multi-walled structure. For example, the inner wall structure and the outer wall structure may include a tubular shell layer, a tubular heat shield layer, and one or more cooling impingement cavities. Primary quench openings 48 may be formed in the inner and/or outer wall structures 32, 34 circumferentially around the longitudinal centerline (X-X) of the engine. The primary quench openings 48 formed in the inner and outer wall structures may be arranged to face one another.

The upstream wall portion 42 may include a swirler 50 to receive a portion (shown as B) of the compressed air exhausted from the high pressure compressor 18. This B portion of compressed air enters into the swirler 50, which generates turbulent flow for rapidly mixing the air with fuel. Another portion of the compressed air (shown as C) may be directed toward the annular plenum 40, which will be used to maintain the combustion process and for cooling for a more uniform temperature profile at the combustion chamber exit. Another portion (shown as D) of the compressed air exhausted from the high pressure compressor 18 may be directed to a fuel vaporizer 80.

The swirler 50 (also known as a dome swirler) may be coupled within an opening 51 formed in the upstream wall portion 42. The swirler 50 may be defined by an annular body 53 including an inner band 52, an outer band 54 defining the swirler periphery, and a plurality of swirler vanes 56 disposed in an annular arrangement between the bands 52, 54. The vanes 56 are positioned within the annulus formed by the inner band 52 and the outer band 54 about a swirler axis SA that may be generally parallel, and in some examples, coaxially aligned with the longitudinal centerline 35 of the combustor. Each of the vanes 56 may be skewed relative to the swirler axis SA for swirling air traveling through the swirler 50 in a toroidal recirculation zone for improved mixing with fuel droplets exiting the fuel vaporizer 80, thereby forming a fuel-air mixture M selected for operating the engine. In an example, the inner band 52, outer band 54 and the swirler vanes 56 are integrally formed together as a unitary structure, for example, in the form of a casting. In one example, one or more of the inner band 52, the outer band 54 and swirler vanes 56 are individually formed and assembled together, for example, by welding, to define the swirler 50. The swirler 50 may be adapted to be an axial swirler or a radial swirler. The swirler 50 may be adapted to produce a swirled flow having a low pressure zone that forces some of the combustion products to recirculate in its core region to meet and mix with incoming fuel and air.

A fuel injector 58 may be included as a part of a fuel delivery system. Fuel may be supplied by various means such as, but not limited to, common rail, line or manifold 60 (as shown) that may be coupled to a fuel reservoir (not shown). Fuel exits the manifold 60, enters into and exits from the fuel injector 58 and enters into the fuel vaporizer 80. Fuel delivered from the fuel injector 58 to the fuel vaporizer 80 may be controlled via a fuel valve system (not shown) as part of the fuel system based the desired combustion efficiency, emissions, and operating conditions. The fuel injector 58 includes an injector housing 62, a nozzle 64 and at least one fuel conduit 66 coupled to the manifold 60. A base 68 of the injector housing 62 mounts the fuel injector 58 to a portion of the outer casing 29 and/or the upstream wall portion 42. The injector housing 62 extends axially out from the fuel conduit 66, through (or into) an injector port 69 formed in the outer casing 29, to the nozzle 64. A fuel port 70 may be provided in the nozzle 64 and may be fluidly coupled with the fuel conduit 66. The nozzle 64 may be adapted to inject fuel through the fuel port 70 and into the fuel vaporizer 80 as described below in further detail, which may be in fluid communication with the D portion of compressed air.

The vaporizer 80 may be defined by a hollow tube 82 extending between a first end opening 86 and a second end opening 88. The vaporizer tube 82 may be coupled to a portion of the combustor wall 31 to extend at least partially into the combustion chamber 45. The hollow tube 82 may have a linear main trunk portion 84 extending downstream about a linear portion of a vaporizer axis VA, which may be in parallel with the centerline 35 of the combustor. In an example, the first end opening 86 (the inlet end) may be mounted to the upstream wall portion 42. To this end, there may be a vaporizer tube port 72 formed in the upstream wall portion 42 and in alignment with the first end opening 86 of the tube 82. One or more attachments (not shown) or bonding may be used to couple the vaporizer 80 to the fuel injector 58 (for example, the injector housing) and/or to the combustor 30 (for example, the upstream wall portion and/or the inner and/or outer wall structures). Examples of such attachment include, but are not limited to, a strut, a vane, a fastener, and a moveable joint such as, for example, a bushing or a bearing. Alternatively, examples of such bonding include, but are not limited to, for example, welding, brazing or adhering.

A portion of the fuel injector 58 extends through the first end opening 86 of the vaporizer tube 82 and resides within the main trunk portion 84. The nozzle 64 of the fuel injector 58 may include the fuel port 70, through which fuel exits the fuel injector 58 and enters into the vaporizer tube 82. The main trunk portion 84 of the vaporizer tube 82 may be circumferentially aligned with the respective residing fuel injector 58. In an example, the main trunk portion 84 of the vaporizer tube 82 may be coaxial with the nozzle 64 (for example, the fuel port 70) of the fuel injector 58. In an example, the outer cross-sectional area of the nozzle 64 may be sized smaller than the inner cross-sectional area of the first end opening 86 and the main trunk portion 84 of the vaporizer tube 82 to define a compressed air passageway 89 therebetween that leads into the vaporizer 80. In an example, a portion of the residing portion of the fuel injector may be attached to the inner wall of the tube 82 by the various attachment means already described herein to leave suitable space for the compressed air passageway 89.

The first end opening 86 may be coaxial with the vaporizer axis VA or coextensive with an end of the main trunk portion 84. One or more radial branch portions 90 may extend from the main trunk portion 84. The radial branch portion 90 may be in fluid communication with the main trunk portion 84, and may extend radially away from the linear portion of the vaporizer axis VA (or generally along a plane that may be generally perpendicular to the longitudinal centerline 35 of the combustor). In an example, the linear portion of the vaporizer axis VA may be offset from the longitudinal centerline 35 of the combustor, with the branch portion 90 extending radially toward the longitudinal centerline 35. The branch portion 90 terminates in a manner such that an end of the branch portion 90 may be coextensive with the second end opening 88 (the outlet end) of the tube 82. The second end opening 88 may be disposed downstream of the first end opening 86 and may be disposed to face upstream toward the upstream wall portion 42 in a spaced relationship from the upstream wall portion. Alternatively, the vaporizer tube 82 may be coupled to the inner or outer wall structures 32, 34 and extend radially toward the centerline 35 of the combustor to place the second end opening over the heat shield.

The main trunk and the branch portion(s) 84, 90 together may define the overall shape of the tube 82, which may be defined as a L-shaped tube or a J-shaped tube having one outlet, T-shaped tube having two outlets, or other shapes having one or more outlets. The tube 82 shown in FIG. 2 is a J-shaped tube where the branch portion 90 is fashioned as arcuate or more rounded or curved. Alternatively, the branch portion 90 of the tube may be fashioned more linearly, or substantially orthogonal (75 to 105 degrees), relative to the main trunk portion. Here, the tube may include an additional tip linear portion coextensive with the second end opening 88, that may be fashioned more linearly, or substantially orthogonal (75 to 105 degrees) relative to the branch portion or substantially parallel (plus or minus 10 degrees) relative to the main trunk portion 84.

The D portion of compressed air enters through the compressed air passageway 89 of the vaporizer tube 82, mixes with fuel exiting the fuel port 70 of the fuel injector 58 to define a fuel-air mixture M, and passes into the interior of the combustion chamber 45 through the second end opening 88 of the vaporizer tube 82. As the fuel-air mixture M passes within the lumen of the vaporizer tube 82, the fuel absorbs heat from the vaporizer tube 82 and may be vaporized to define the fuel-air mixture M. Since the vaporizer 80 may be susceptible to high heat loads from the combustion process, the vaporization of the fuel may help cool the vaporizer, as well as cooling from the D portion of compressed air flowing through the interior of the vaporizer tube. Cooling may also be provided from the fuel from the nozzle being directed at the internal surface of the vaporizer tube.

A heat shield 100 may be included along the combustor to protect portions of the combustor wall from the hot burner gases and from an unacceptably high radiation effect from the combustion process. The heat shield 100 may be included along the upstream wall portion 42 of the combustor 30. Impinging fuel-air mixture M may be adapted to cool the heat shield 100. The heat shield 100 may be adapted to direct or deflect radially, downstream, or a combination of both the fuel-air mixture M after impingement toward the swirler 50. After impingement, the fuel-air mixture M may be combined with the B portion of compressed air exiting the swirler 50 to become part of the primary zone recirculation. The second end opening 88 of the vaporizer tube 82 may be oriented over the heat shield 100 in order to provide the impinging fuel-air mixture M exiting the vaporizer 80 directly against the heat shield 100. The heat shield 100 and the second end opening 88 of the vaporizer tube 82 may be arranged such that the fuel-air mixture M exiting the tube 82 impinges along an intermediate zone or at a central zone of the heat shield 100. In an example, the body of the heat shield 100 may include an outer periphery 102, which may be in a circular form, defined about a heat shield axis DA extending at the center of the heat shield body. Here, the heat shield axis DA may be coaxial with a second vaporizer axis OA at the second end opening 88 of the vaporize tube 82.

The heat shield 100 may have various shapes to encourage or be adapted for the radial outward and/or downstream circulation of fuel-air mixture M. In an example, the body of the heat shield 100 may have a concave or bowl shape to define a concaved heat shield body. The heat shield 100 may project or protrude upstream from the upstream wall portion 42 of the combustor 30. In an example, the heat shield 100 may be shaped as a circular bowl. In an example, the heat shield 100 may be disposed along a central part of the swirler 50. In an example, when the heat shield 100 is circular about the heat shield axis DA, the heat shield axis DA may be coaxial with the swirler axis SA. In an example, the swirler and heat shield may be located generally about the central area of the upstream wall portion 42 such that the heat shield axis DA, the swirler axis SA, the second vaporizer axis OA, or any combination thereof, may be coaxial with the longitudinal centerline 35 of the combustor.

The swirler 50 may be defined as including the heat shield 100. In an example, the heat shield 100 may be formed integrally with the swirler 50 as a single unit, such as, for example, by a casting process, by which the single unit may be then mounted into an aperture formed in the upstream wall portion 42. Alternatively, the body of the heat shield 100, such as, for example, a central concaved body, may be coupled to the surrounding annulus body of the swirler 50 to define a single assembly, which may be then mounted into an aperture formed in the upstream wall portion 42. One or more attachments (not shown) or bonding may be used to couple the heat shield to the swirler and/or to the combustor (for example, the upstream wall structure and/or the inner and/or outer wall structures). Examples of such attachment include, but are not limited to, a strut, a vane, a fastener, and a moveable joint such as, for example, a bushing or a bearing. Alternatively, examples of such bonding include, but are not limited to, for example, welding, brazing or adhering.

During operation of the gas turbine engine of FIG. 2, the combustor plenum 40 receives compressed air (shown as A) from the high pressure compressor. Some of the air will be provided to the combustor 30 from the plenum 40 for the combustion process. For example, some of the air (the D portion of compressed air) within the plenum 40 may be directed through the vaporizer 80 for mixing with the fuel dispensed by the fuel injectors to provide the fuel-air mixture M. As a result of the combustion process, thermal energy may be released which may radiate upstream through the combustion chamber 45 to heat the vaporizer 80 to vaporize some or substantially all of the fuel dispensed against the heated surface of the vaporizer tube. The fuel-air mixture M may be ignited within the combustion chamber 45, for example by one or more igniters (not shown), to power the gas turbine engine. Fuel-air mixture M exiting the vaporizer 80 impinges against the heat shield 100 that may be adapted to redirect the impinging fuel-air mixture M radially outward and/or downstream toward the swirler 50. The impinging fuel-air mixture M may be then combined with the B portion of compressed air being formed into a toroidal recirculation air to become part of the primary zone recirculation in the combustor. The primary quench openings 48 may direct additional air (the C portion of compressed air) from the plenum 40 into the combustion chamber 45 downstream of the vaporizer 80 for controlling the fuel-air mixture and/or cooling the combusted air prior to be introduced to the turbines.

Figure 3:
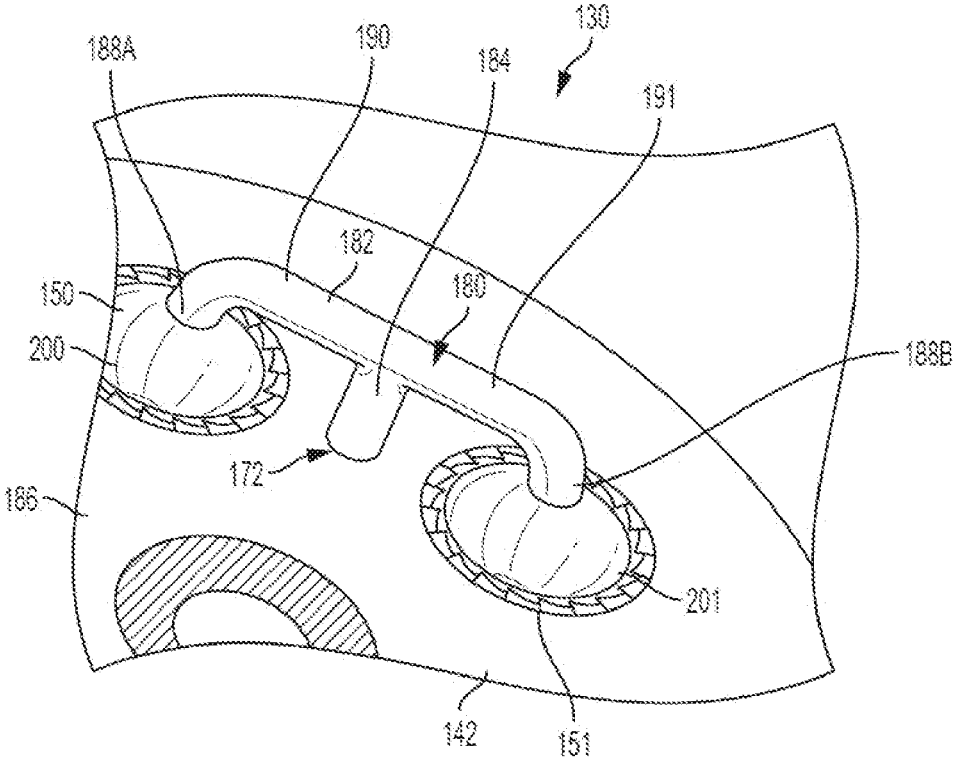
FIG. 3 illustrates a perspective partial view of another example of a combustor.

FIG. 3 depicts a partial view of another example of the combustor configuration which could be included in the gas turbine engine 10. Here, the combustor 130 includes multiple swirlers, heat shields, vaporizer tubes (only one shown), or any combination thereof, similar to what is described above with respect to FIG. 2. In an example, FIG. 3 depicts the combustor 130 including a first swirler 150 and a corresponding first heat shield 200 and a second swirler 151 and a corresponding second heat shield 201 disposed along the upstream wall portion 142 between the inner wall structure and the outer wall structure (not shown). Each set of a combination of the swirler and the heat shield may include its own fuel vaporizer, similar to what is described above. Alternatively, each set of a combination of the swirler and the heat shield may share a common fuel vaporizer 180, as shown in FIG. 3. In an example, the combustor 130 may be further configured to include multiple sets of the combination of the swirlers and heat shields and the vaporizer tubes spaced equally around a circumference of the upstream wall portion in the shape of an annulus.

The fuel vaporizer tube 182 may be coupled to the tube port 172 formed in the upstream wall portion 142 radially outside of both of (or in between) the first swirler 150 and the second swirler 151. The vaporizer tube 182 may be shaped to place a first 188A of the second end openings over the first heat shield 200, for example, over a central zone of the first heat shield 200, and to place a second 188B of the second end openings over the second heat shield 201, for example, a central zone of the second heat shield 201, with the second end openings 188A, 188B facing the respective first and second heat shields 200, 201.

In an example, the vaporizer tube 182 may be defined by a main trunk portion 184 extending from the upstream wall portion 142 into the combustion chamber (not shown). In an example, the main trunk portion 184 may be extended along the longitudinal centerline of the combustor. The tube 182 may be also defined by a first branch portion 190 and a second branch portion 191 extending radially away from the main trunk portion 184. To this end, the main trunk portion 184 terminates into, while maintaining fluid communication with, the inlet ends of the first and second branch portions 190, 191. An inlet end of the main trunk portion 184 may be coextensive with the first end opening 186 of the tube 182. An outlet end of the first branch portion 190 may be coextensive with the first 188A of the second end openings, while an outlet end of the second branch portion 191 may be coextensive with the second 188B of the second end openings. The branch portions 190, 191 may extend along a plane that may be generally perpendicular to the longitudinal centerline of the combustor. Internal baffles and flow dividers (not shown) may be included within the vaporizer tube 182, for example in close proximity to the intersection of the main trunk portion and the radial branch portions, to improve mixing of the fuel and air mixture and for equally dividing the fuel and air mixture entering into the branch portions.

Operation here would be similar to what is described above. For example, some of the air within the combustor plenum may be directed through the vaporizer 180 for mixing with the fuel dispensed by the fuel injectors to provide the fuel-air mixture. Fuel-air mixture exiting the second openings 188A. 188B of the vaporizer tube 182 impinges against the corresponding heat shields 200, 201.

To clarify the use of and to hereby provide notice to the public, the phrases "at least one of <A>, <B>, . . . and <N>" or "at least one of <A>, <B>, <N>, or combinations thereof" or "<A>, <B>, . . . and/or <N>" are defined by the Applicant in the broadest sense, superseding any other implied definitions hereinbefore or hereinafter unless expressly asserted by the Applicant to the contrary, to mean one or more elements selected from the group comprising A, B, . . . and N. In other words, the phrases mean any combination of one or more of the elements A, B, . . . or N including any one element alone or the one element in combination with one or more of the other elements which may also include, in combination, additional elements not listed.

While various embodiments have been described, it will be apparent to those of ordinary skill in the art that many more embodiments and implementations are possible. Accordingly, the embodiments described herein are examples, not the only possible embodiments and implementations.

Furthermore, the advantages described above are not necessarily the only advantages, and it is not necessarily expected that all of the described advantages will be achieved with every embodiment.

What is claimed is:

1. A combustor for a gas turbine engine, comprising:

a combustor wall including an upstream wall portion interconnected between an inner wall structure and an outer wall structure to define a combustion chamber, the combustion chamber defined about a longitudinal centerline of the combustor;

a vaporizer tube having a first end opening and a second end opening;

a fuel injector extending through the first end opening along a portion of the vaporizer tube, the fuel injector having an outer cross-sectional area sized smaller than an inner cross-sectional area of the first end opening and the vaporizer tube to define a compressed air passageway into the vaporizer tube;

a swirler coupled to the upstream wall portion, wherein the swirler comprises an axial swirler; and a heat shield surrounded by the swirler;

wherein the vaporizer tube is coupled to a port formed in the upstream wall portion outside the swirler and is extended within the combustion chamber, and the vaporizer tube is shaped to place the second end opening over the heat shield, wherein the second end opening faces the heat shield such that a fuel-air mixture exiting the second end opening impinges against the heat shield, and the swirler comprises a plurality of swirler vanes arranged in the swirler to create toroidal recirculation air that mixes with the impinging fuel-air mixture between the second end opening and the heat shield, wherein the swirler, the heat shield, and the second end opening are co-axially aligned with the longitudinal center line of the combustor.

2. The combustor of claim 1, wherein the heat shield includes a concaved body having an upstream side and a downstream side, and wherein the upstream side of the concaved body is configured to direct a flow of compressed air to the swirler, and the fuel-air mixture impinges against the downstream side.

3. The combustor of claim 2, further comprising a diffuser inlet positioned to direct compressed air linearly at the upstream side of the heat shield, the upstream side configured to divert the compressed air around the heat shield toward the surrounding swirler for receipt by the swirler vanes.

4. The combustor of claim 2, wherein the concaved body of the heat shield has a circular periphery defined about a heat shield axis.

5. The combustor of claim 4, wherein an axis of the vaporizer tube at the second end opening is coaxial with the heat shield axis and the swirler.

6. The combustor of claim 1, wherein the vaporizer tube is defined by a main trunk portion and a branch portion extending radially from the main trunk portion, an end of the main trunk portion coextensive with the first end opening and an end of the branch portion coextensive with the second end opening, wherein the fuel injector extends within the main trunk portion of the vaporizer tube.

7. The combustor of claim 6, wherein the heat shield includes a concaved body having a circular periphery defined about a heat shield axis, and the swirler includes an inner band extending along the circular periphery of the concaved body of the heat shield, an outer band, and the plurality of swirler vanes are disposed in an annular arrangement between the inner and outer bands.

8. The combustor of claim 6, wherein the main trunk portion is disposed about a linear portion of a vaporizer axis, and the branch portion extends away from the linear portion of the vaporizer axis in a curved fashion to dispose the second end opening in a spaced relationship with the heat shield.

9. The combustor of claim 1, wherein the swirler is a first swirler, the heat shield is a first heat shield, and the vaporizer tube includes another second end opening, the combustor further comprising a second swirler coupled to the upstream wall portion adjacent the first swirler, a second heat shield disposed along the upstream wall portion, surrounded by the second swirler, wherein the vaporizer tube is coupled to the upstream wall portion between the first swirler and the second swirler, wherein the vaporizer tube is shaped to place one of the second end openings over a central zone of the first heat shield to face the first heat shield, and to place the other of the second end openings over a central zone of the second heat shield to face the second heat shield.

10. The combustor of claim 9, wherein the vaporizer tube is defined by a main trunk portion and a first branch portion and a second branch portion each extending radially from the main trunk portion, an end of the main trunk portion is coextensive with the first end opening, an end of the first branch portion is coextensive with one of the second end openings, and an end of the second branch portion is coextensive with the other of the second end openings, wherein the fuel injector extends within the main trunk portion of the vaporizer tube.

11. The combustor of claim 1, wherein the port is formed in the upstream wall portion offset from the longitudinal center-line of the combustor.

12. A gas turbine engine, comprising:

a combustor to receive compressed air from a compressor and to deliver combustion products to a turbine, the combustor having a combustor wall including an upstream wall portion interconnected between an inner wall structure and an outer wall structure to define a combustion chamber, the combustion chamber defined about a longitudinal centerline of the combustor;

a fuel vaporizer tube coupled to the combustor wall extending into the combustion chamber, the vaporizer tube having a first end opening and a second end opening;

a swirler coupled to the upstream wall portion, the swirler comprising an axial swirler having a plurality of swirler vanes arranged to create toroidal recirculation air; and a heat shield coaxially positioned with respect to the swirler as part of the upstream wall portion, wherein the heat shield is surrounded by the swirler, wherein the second end opening of the vaporizer tube is disposed over the heat shield and faces the heat shield so that a fuel-air mixture exiting the second end impinges against the heat shield and combines, between the heat shield and the second end, with the toroidal recirculation air, wherein the swirler, the heat shield, and the second end opening are co-axially aligned with the longitudinal center line of the combustor.

13. The combustor of claim 12, wherein the swirler vanes are skewed relative to a swirler axis to create, with the toroidal recirculation air, a toroidal recirculation zone between the second end opening and the heat shield, the toroidal recirculation zone including a low pressure zone in which at least some of the combustion products are recirculated.

14. The gas turbine engine of claim 12, further comprising a fuel injector having a nozzle extending within a portion of the vaporizer tube through the first end opening, wherein the nozzle of the fuel injector has an outer cross-sectional area sized smaller than an inner cross-sectional area of the first end opening and the vaporizer tube to allow compressed air to enter the vaporizer tube where it is mixed with fuel delivered from the nozzle to define a fuel-air mixture to impinge against the heat shield when the fuel-air mixture exits the second end opening of the vaporizer tube.

15. The gas turbine engine of claim 14, wherein the vaporizer tube is coupled to the upstream wall portion of the combustor wall radially outside the swirler.

16. The gas turbine engine of claim 15, wherein the heat shield includes a concaved body to deflect the impinging fuel-air mixture radially outward and downstream to further combine with compressed air through the swirler.

17. The gas turbine engine of claim 15, wherein the vaporizer tube is defined by a main trunk portion and a branch portion extending radially from the main trunk portion, an end of the main trunk portion coextensive with the first end opening and an end of the branch portion coextensive with the second end opening, wherein the nozzle of the fuel injector extends within the main trunk portion of the vaporizer tube.

18. The gas turbine engine of claim 17, wherein the main trunk portion is disposed about a linear portion of a vaporizer axis, and the branch portion extends away from the linear portion of the vaporizer axis in a curved fashion to dispose the second end opening in a spaced relationship with the heat shield.

19. The gas turbine engine of claim 18, where an outer periphery of the heat shield is defined about a heat shield axis, wherein the second end opening is defined about an axis of the vaporizer tube that is coaxial with the heat shield axis.

20. The gas turbine engine of claim 12, wherein the swirler is a first swirler, the heat shield is a first heat shield, and the vaporizer tube includes another second end opening, wherein the combustor further comprises a second swirler coupled to the upstream wall portion adjacent the first swirler, a second heat shield disposed along the upstream wall portion, surrounded by the second swirler, wherein the vaporizer tube is coupled to the upstream wall portion between the first swirler and the second swirler, wherein the vaporizer tube is shaped to place one of the second end openings over a central zone of the first heat shield to face the first heat shield, and to place the other of the second end openings over a central zone of the second heat shield to face the second heat shield.

21. The gas turbine engine of claim 20, wherein the vaporizer tube is defined by a main trunk portion and a first branch portion and a second branch portion each extending radially from the main trunk portion, an end of the main trunk portion is coextensive with the first end opening, an end of the first branch portion is coextensive with one of the second end openings, and an end of the second branch portion is coextensive with the other of the second end openings, wherein a fuel injector extends within the main trunk portion of the vaporizer tube.

22. A combustor for a gas turbine engine, comprising:

a combustor wall including an upstream wall portion interconnected between an inner wall structure and an outer wall structure to define a combustion chamber, the combustion chamber defined about a longitudinal centerline of the combustor;

a vaporizer tube coupled to the combustor wall and extending within the combustion chamber, the vaporizer tube having a first end opening and a second end opening, a main trunk portion having an end coextensive with the first end opening, the main trunk portion disposed about a vaporizer axis, and a branch portion having an end coextensive with the second end opening; and a swirler coupled to the upstream wall portion, the swirler comprising an axial swirler having an annulus body and a concaved heat shield body extending from the annulus body, wherein the vaporizer tube is coupled to the upstream wall portion radially outside a periphery of the swirler in alignment with an opening formed in the upstream wall portion, and the branch portion extends away from the vaporizer axis in a manner to dispose the second end opening over a central zone of the concaved heat shield body such that a fuel-air mixture exiting the vaporizer tube impinges against the concaved heat shield body and the impinging fuel-air mixture is combined with toroidal recirculation air between the second end and the concaved heat shield, wherein the swirler, the heat shield, and the second end opening are co-axially aligned with the longitudinal center line of the combustor.

23. The combustor of claim 22, further comprising a fuel injector having a nozzle extending within the main trunk portion of the vaporizer tube through the first end opening, wherein the nozzle of the fuel injector has an outer cross-sectional area sized smaller than an inner cross-sectional area of the first end opening and the main trunk portion to define a compressed air passageway.

* * * * *